US009752767B1

(12) United States Patent
Moghal

(10) Patent No.: US 9,752,767 B1
(45) Date of Patent: Sep. 5, 2017

(54) COMPACT LIGHTING SYSTEM

(71) Applicant: Khurram Zeshan Moghal, Senoia, GA (US)

(72) Inventor: Khurram Zeshan Moghal, Senoia, GA (US)

(73) Assignee: Cooper Technologies Company, Houston, TX (US)

( * ) Notice: Subject to any disclaimer, the term of this patent is extended or adjusted under 35 U.S.C. 154(b) by 69 days.

(21) Appl. No.: 14/929,123

(22) Filed: Oct. 30, 2015

(51) Int. Cl.

| | |
|---|---|
| ***F21V 33/00*** | (2006.01) |
| ***F21V 29/70*** | (2015.01) |
| ***F21V 29/74*** | (2015.01) |
| ***F21V 29/60*** | (2015.01) |
| ***F21V 29/508*** | (2015.01) |
| *F21Y 101/02* | (2006.01) |

(52) U.S. Cl.
CPC ..... *F21V 29/70* (2015.01); *F21V 29/508* (2015.01); *F21V 29/60* (2015.01); *F21V 29/74* (2015.01); *F21Y 2101/02* (2013.01)

(58) Field of Classification Search
CPC ..... F21V 29/70; F21V 29/508; F21V 29/60; F21V 29/74
USPC ..... 362/234
See application file for complete search history.

(56) References Cited

U.S. PATENT DOCUMENTS 5,838,860 A * 11/1998 Kingstone ..... F21V 29/74 385/100
8,456,816 B2 * 6/2013 Hirota ..... H05K 5/0017 248/454
2006/0067077 A1 * 3/2006 Kumthampinij ..... F21L 4/027 362/294
2008/0285265 A1 * 11/2008 Boissevain ..... F21S 8/086 362/218
2012/0106176 A1 * 5/2012 Lopez ..... F21K 9/00 362/382
2013/0088869 A1 * 4/2013 Yun ..... F21V 29/004 362/249.01
2013/0088871 A1 * 4/2013 Yun ..... F21V 29/51 362/249.01
2013/0155688 A1 * 6/2013 LaVigna ..... F21V 21/00 362/311.01
2014/0247590 A1 * 9/2014 Wilcox ..... F21V 29/74 362/231
2014/0254156 A1 * 9/2014 Hsu ..... F21V 27/02 362/249.1

(Continued)

*Primary Examiner* — Bryon T Gyllstrom
(74) *Attorney, Agent, or Firm* — King & Spalding LLP

(57) ABSTRACT

A lighting system includes a housing. The housing includes a light source portion, an electronic component portion, and a partition wall that is disposed between the light source portion and the electronic component portion. Further, the housing includes a channel that extends at an angle downwards from a portion of the partition wall to the light source portion. The channel provides a passageway from the electronic component portion to the light source portion of the housing. A grommet is disposed in the inclined channel to prevent external environmental elements, such as dust, water, etc., from entering the electronic component portion from the light source portion. Further, the lighting system includes a mounting bracket on which one or more electronic components associated with the lighting system are mounted. The mounting bracket is disposed within the electronic component portion and coupled to a surface of the electronic component portion.

20 Claims, 12 Drawing Sheets

(56) References Cited

U.S. PATENT DOCUMENTS

| | | | | |
|---|---|---|---|---|
| 2015/0214451 | A1* | 7/2015 | Abe | F21S 4/28<br>362/382 |
| 2016/0118569 | A1* | 4/2016 | Feng | F21S 9/04<br>362/157 |
| 2016/0320046 | A1* | 11/2016 | Duckworth | F21V 29/74 |

* cited by examiner

COMPACT LIGHTING SYSTEM

TECHNICAL FIELD

Embodiments of the invention relate generally to lighting systems. Specifically, embodiments of the present disclosure relate to compact lighting systems having a single-piece housing, an electronic component mounting bracket for thermal management, and water/dust sealing compartments.

BACKGROUND

In recent years, there has been substantial interest in energy-efficient technology including energy efficient lighting. Solid state light technology, such as light emitting diode (LED) technology has the potential to operate efficiently, but may produce unwanted and undesirable heat. The thermal load generated by LEDs in conventional LED lighting fixtures may reduce the effective life of the electronics associated with the LEDs thereby reducing the effective life of the light fixture itself. Existing heat management strategies in conventional LED lighting fixtures may be incompletely effective. Further, conventional light fixtures are generally large in size for high lumen packages. Accordingly, there is need for a lighting system that overcomes the above-mentioned shortcomings of conventional lighting fixtures.

SUMMARY

In one aspect, the present disclosure can relate to a lighting system. The lighting system includes a housing. The housing includes a light source portion having a base. Further, the housing includes an electronic component compartment configured to house one or more electronic components. In addition, the housing includes a partition wall that is disposed between the light source portion and the electronic component compartment. The partition wall separates the light source portion from the electronic component compartment. Further, the housing includes a channel defined by the partition wall and the base. The channel extends from the partition wall to the base providing a passageway from the electronic component compartment to the light source portion of the housing. The channel is integral to the housing. Further, the channel is inclined and extends downwards at an angle from the electronic component compartment to the light source portion. The lighting system includes a light source module that is coupled to the base of the light source portion. The light source module comprises one or more light sources. Further, the lighting system includes a grommet that is disposed in the channel to prevent an entry of external environmental elements from the light source portion of the housing to the electronic component compartment of the housing.

In another aspect, the present disclosure can relate to a lighting system. The lighting system includes a housing, where the housing is a single-piece housing. The housing includes at least (i) a light source portion that is configured to be coupled to a light source module comprising one or more light sources, and (ii) an electronic component compartment that is configured to house one or more electronic components. Further, the housing includes a partition wall disposed between the light source portion and the electronic component compartment. The partition wall separates the light source portion from the electronic component compartment. Additionally, the lighting system includes a mounting bracket that is disposed within a cavity defined by the electronic component compartment in concert with the partition wall of the housing. In particular, the mounting bracket is removably coupled to a surface of the electronic component compartment. Further, the one or more electronic components housed in the electronic component compartment are mounted on the mounting bracket. Furthermore, the mounting bracket is configured to provide a thermal barrier between the light source portion and the one or more electronic components disposed in the electronic component compartment to reduce an effect of heat generated by the one or more light sources on the one or more electronic components.

These and other aspects, objects, features, and embodiments will be apparent from the following description and the appended claims.

BRIEF DESCRIPTION OF THE FIGURES

Reference will now be made to the accompanying drawings, which are not necessarily drawn to scale, and wherein.

Figure 1:
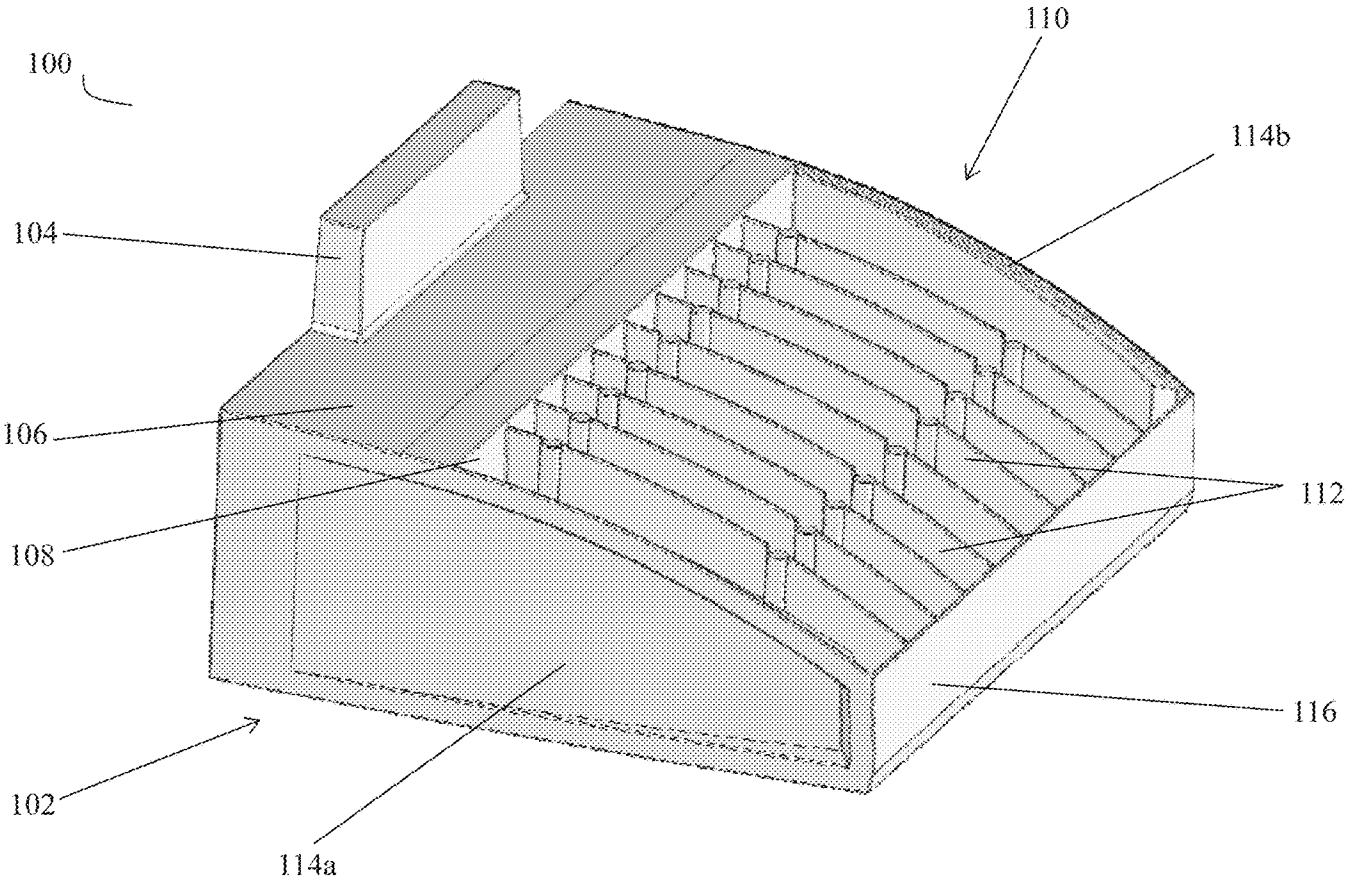
FIG. 1 illustrates a perspective view of a lighting system, in accordance with example embodiments of the present disclosure.

The drawings illustrate only example embodiments of the invention and are therefore not to be considered limiting of its scope, as the invention may admit to other equally effective embodiments. In the drawings, reference numerals designate like or corresponding, but not necessarily identical, elements.

DETAILED DESCRIPTION OF EXAMPLE EMBODIMENTS

In the following paragraphs, the present disclosure will be described in further detail by way of examples with reference to the attached drawings. In the description, well known components, methods, and/or processing techniques are omitted or briefly described so as not to obscure the disclosure. As used herein, the "present disclosure" refers to any one of the embodiments of the disclosure described herein and any equivalents. Furthermore, reference to various feature(s) of the "present disclosure" is not to suggest that all embodiments must include the referenced feature(s).

The present disclosure is directed to an example lighting system having a compressed/compact form factor and improved thermal management features compared to conventional lighting systems. The example lighting system of the present disclosure includes a single-piece housing having a light source compartment that houses one or more light sources, and an electronic component compartment that houses one or more electronic components associated with the light sources in a single casting.

In particular, the one or more electronic components of the lighting system may be coupled to/mounted on an electronic component mounting bracket that provides segregation from the thermal load generated by the light source to reduce the damaging effects of the light source thermal load on the electronic components. The electronic component mounting bracket is disposed in the electronic component compartment and coupled to the housing to provide optimal heat sinking. In other words, the electronic component mounting bracket is configured to operate both as a heat sink and a thermal barrier (from the thermal load of the light sources) for the electronic components.

Further, the lighting system includes a water/dust intrusion grommet that is configured to and disposed in the lighting system such that the effects of water/dust entry into the driver compartment are reduced. In particular the water/dust intrusion grommet is disposed in an inclined channel (channel inclined downwards from the electronic component compartment to the light source compartment) formed between the electronic component compartment and the light source compartment to minimize water/dust entry from the light source compartment into the electronic component compartment.

Even though the present disclosure describes the housing as a single-piece component, one of ordinary skill in the art can understand and appreciate that in some embodiments, the housing may be a multi-piece/multi-part component that needs to be coupled together using coupling devices. Further, even though the present disclosure describes that the single-piece housing includes a light source compartment and an electronic component compartment, one of ordinary skill in the art can understand and appreciate the housing can include a lesser or greater number of compartments without departing from a broader scope of the present disclosure.

The technology of the present disclosure can be embodied in many different forms and should not be construed as limited to the embodiments set forth herein; rather, these embodiments are provided so that this disclosure will be thorough and complete, and will fully convey the scope of the technology to those having ordinary skill in the art. Furthermore, all "examples" or "exemplary embodiments" given herein are intended to be non-limiting and among others supported by representations of the present technology.

Figure 2:
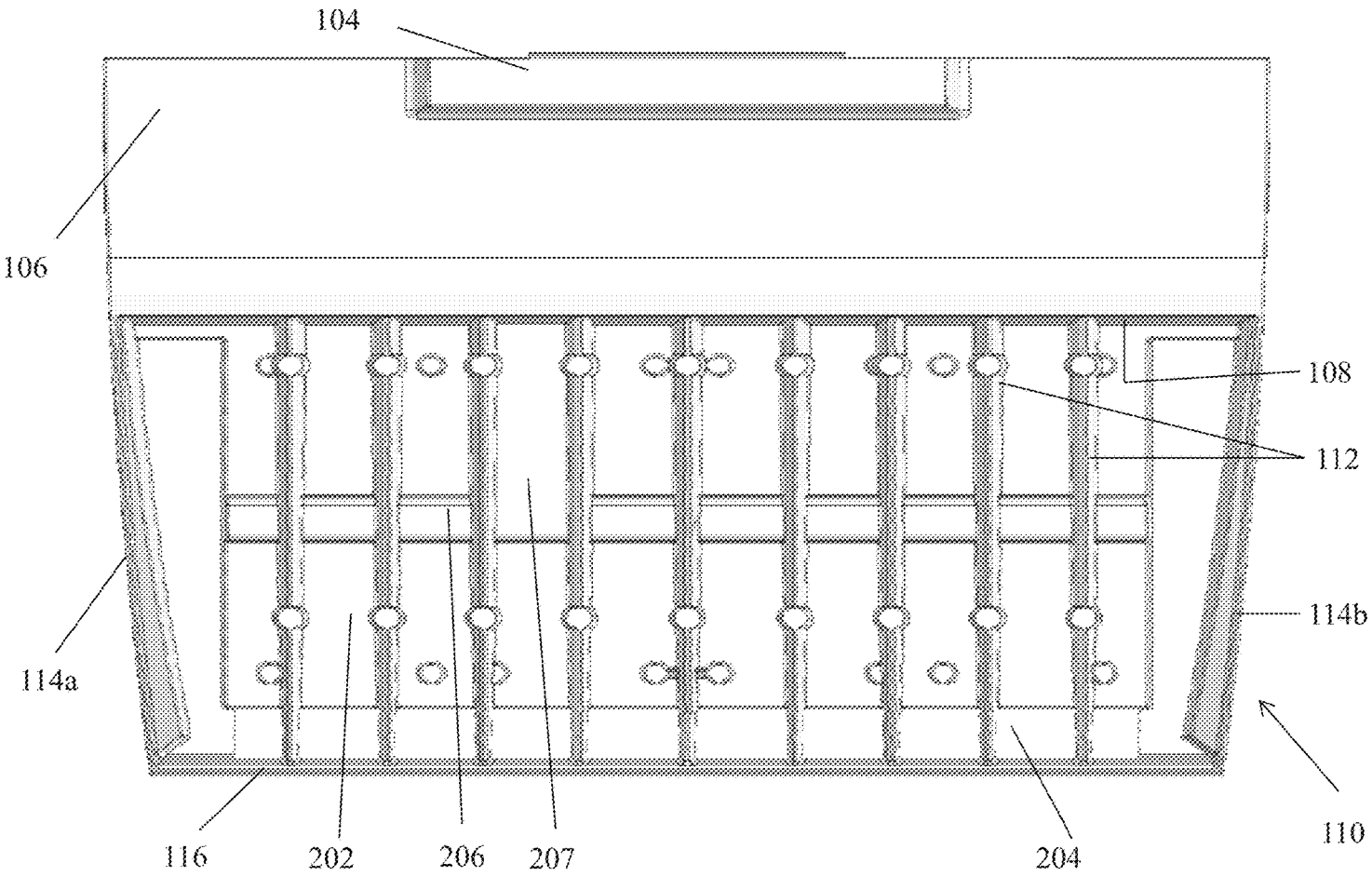
FIG. 2 illustrates a top view of the lighting system, in accordance with example embodiments of the present disclosure.
Figure 3:
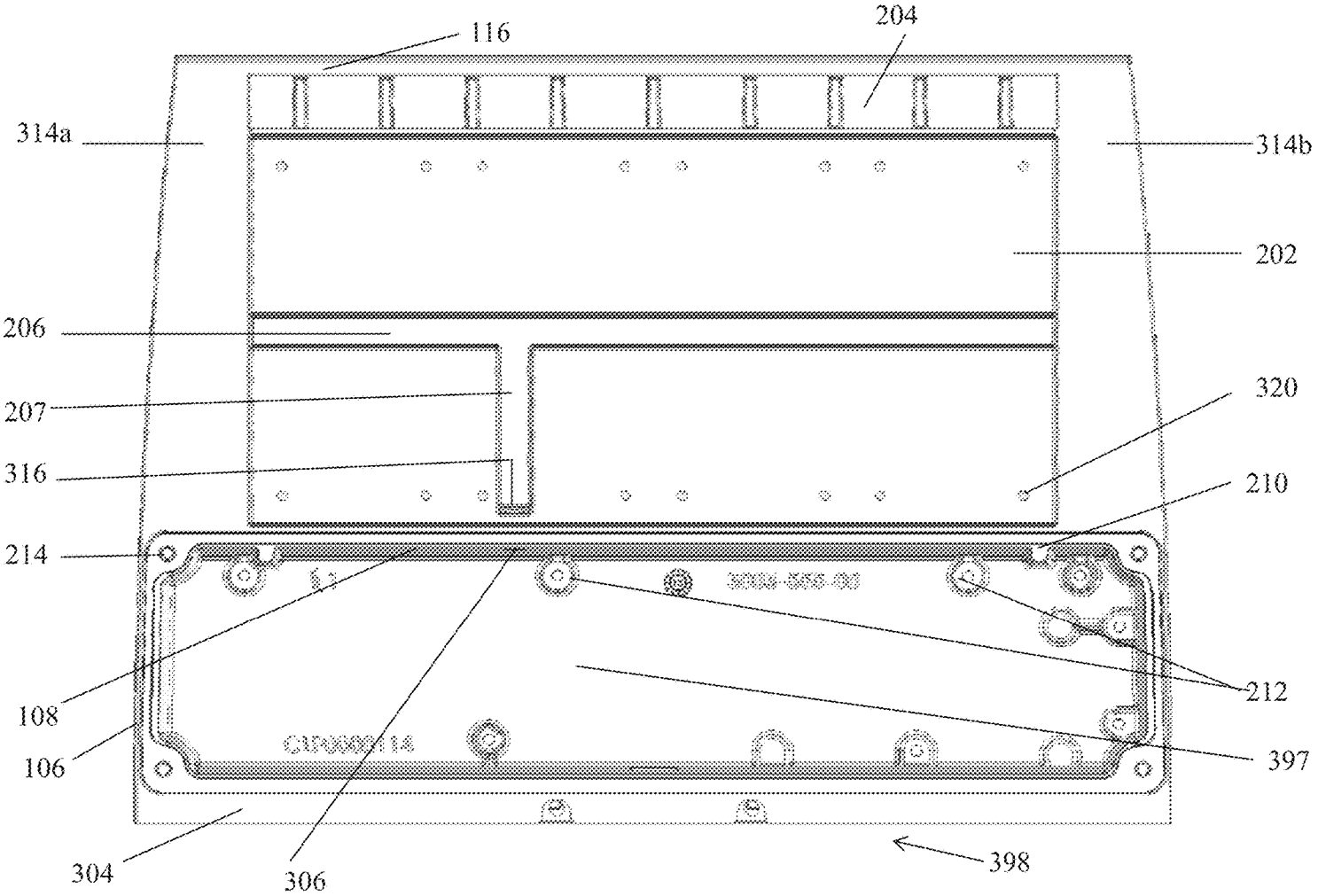
FIG. 3 illustrates a bottom view of a housing of the lighting system with certain components removed, in accordance with example embodiments of the present disclosure.
Figure 4:
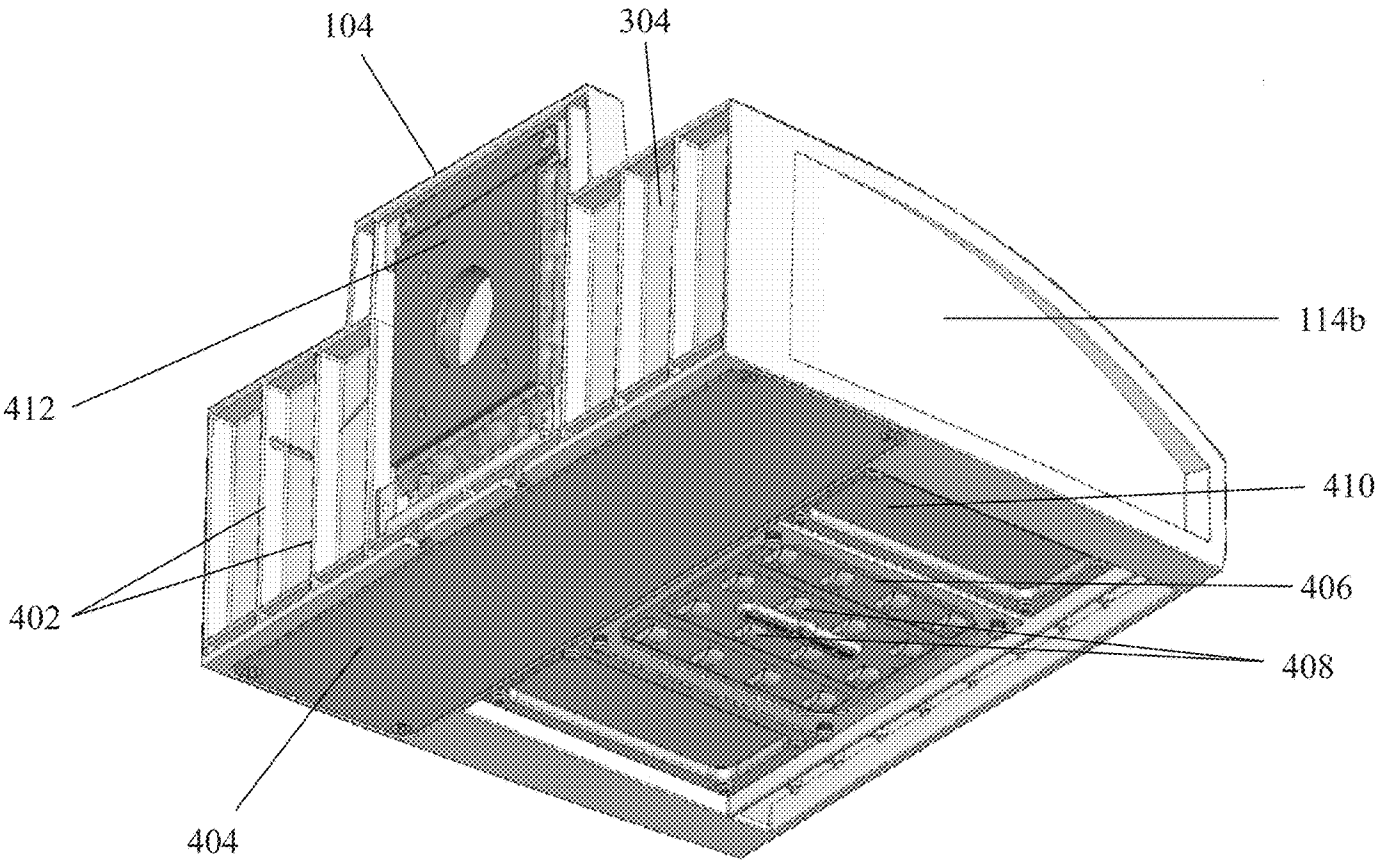
FIG. 4 illustrates another perspective view of the lighting system, in accordance with example embodiments of the present disclosure.

FIGS. 1-4 illustrate various views of the lighting system and the single-piece housing of the lighting system, according to example embodiments of the present disclosure. In particular, FIG. 1 illustrates a perspective view of a lighting system, in accordance with example embodiments of the present disclosure; FIG. 2 illustrates a top view of the lighting system, in accordance with example embodiments of the present disclosure; FIG. 3 illustrates a bottom view of a housing of the lighting system absent a remainder of the components of the lighting system, in accordance with example embodiments of the present disclosure; and FIG. 4 illustrates another perspective view of the lighting system, in accordance with example embodiments of the present disclosure.

Figure 5:
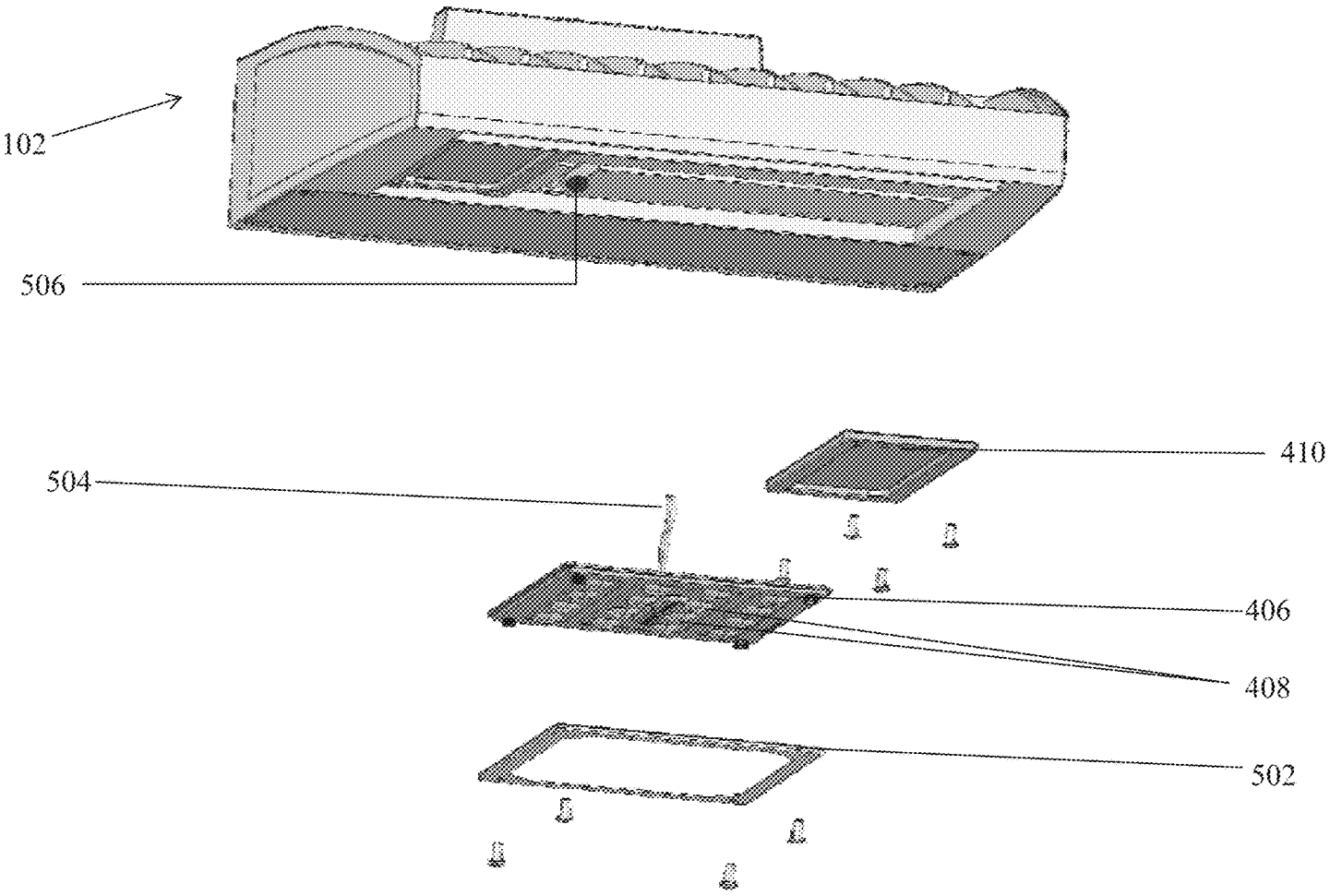
FIG. 5 illustrates an exploded view of a light source module and a water/dust grommet of the lighting system, in accordance with example embodiments of the present disclosure.
Figure 6:
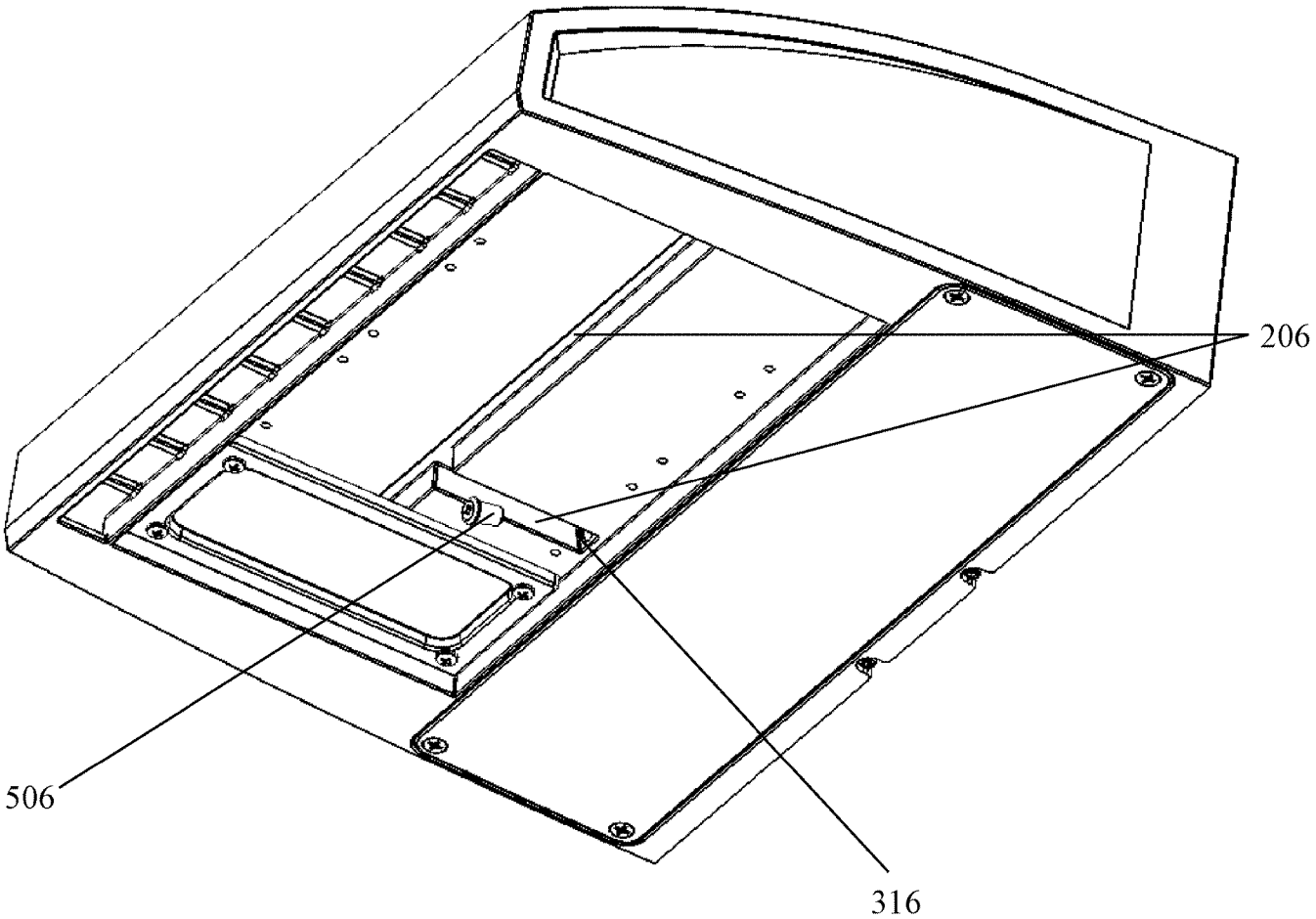
FIG. 6 illustrates a zoomed in view of the water/dust grommet and it's arrangement in the lighting system, in accordance with example embodiments of the present disclosure.
Figure 7:
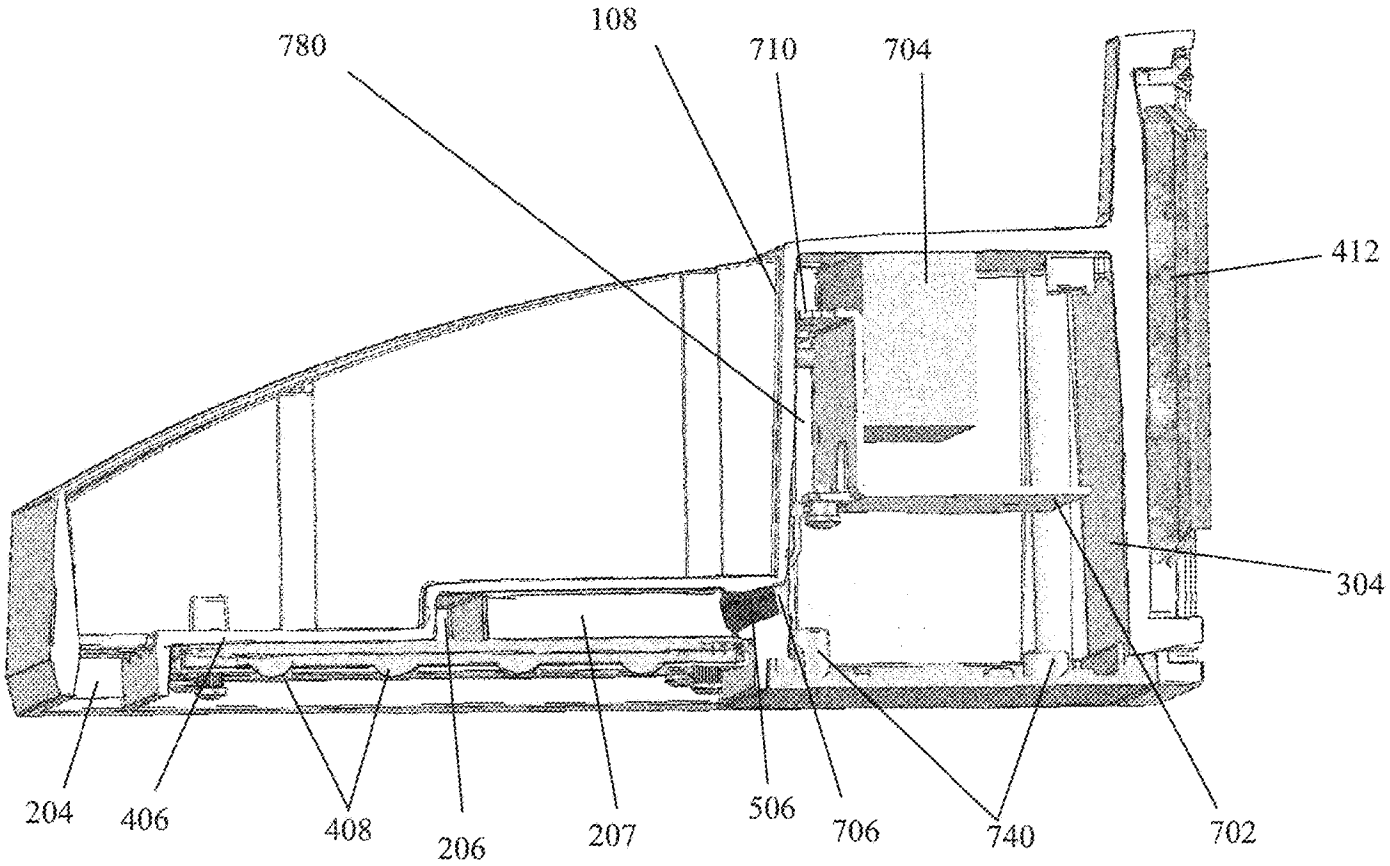
FIG. 7 illustrates a cross-sectional view of the lighting system, in accordance with example embodiments of the present disclosure.
Figure 8:
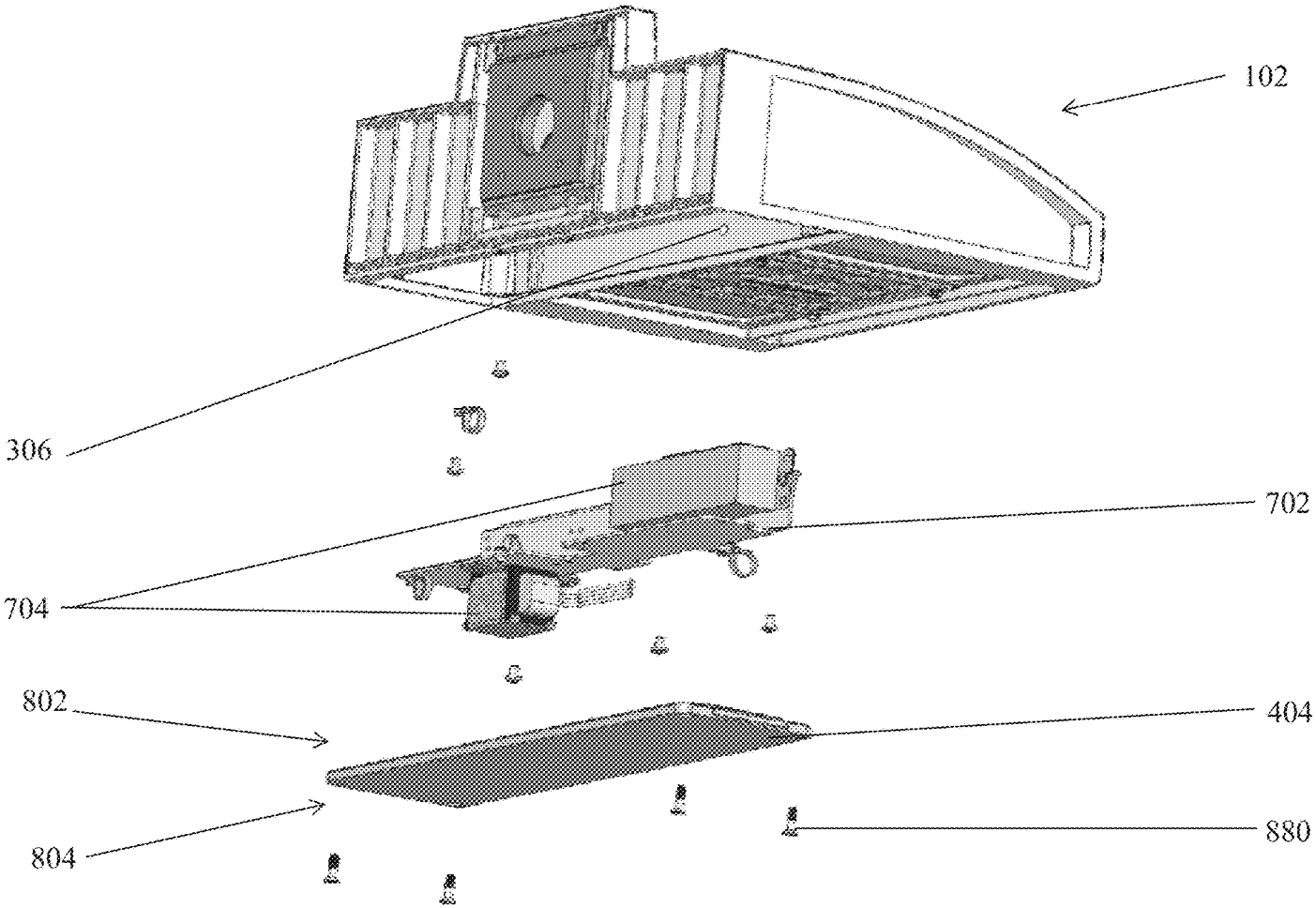
FIG. 8 illustrates an exploded view of an electronic component module of the lighting system, in accordance with an example embodiment of the lighting module.
Figure 12:
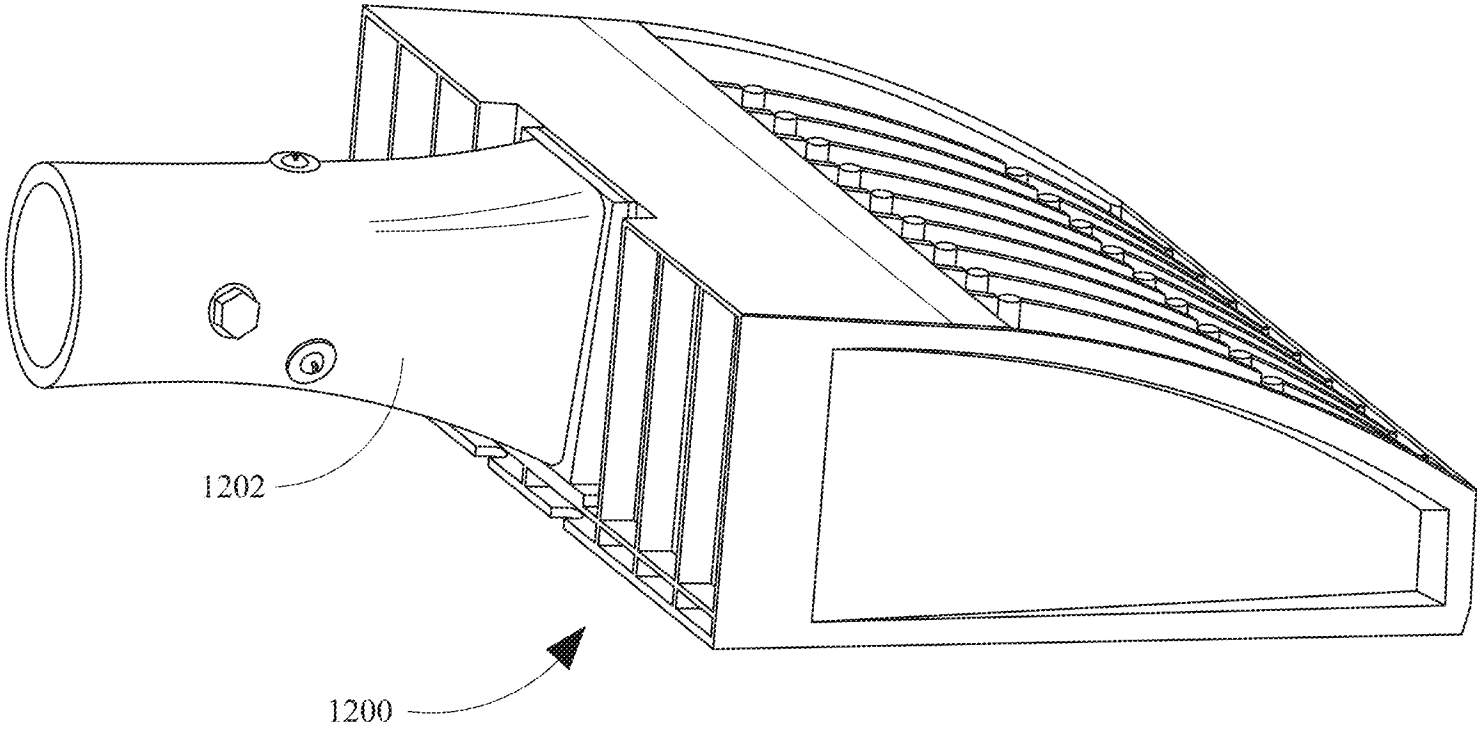
FIG. 12 illustrates a perspective view of the lighting system coupled to a mounting mast arm, in accordance with example embodiments of the present disclosure.

Further, FIG. 5 illustrates an exploded view of a light source module and a water/dust grommet of the lighting system, in accordance with example embodiments of the present disclosure; FIG. 6 illustrates a zoomed in view of the water/dust grommet and it's arrangement in the lighting system, in accordance with example embodiments of the present disclosure; FIG. 7 illustrates a cross-sectional view of a lighting fixture, in accordance with example embodiments of the present disclosure; FIG. 8 illustrates an exploded view of an electronic component module of the lighting system, in accordance with an example embodiment of the lighting module; and FIG. 12 illustrates a perspective view of the lighting system coupled to a mounting mast arm, in accordance with example embodiments of the present disclosure.

Referring to FIGS. 1-8 and 12, a lighting system 100 may include a single-piece housing 102. For example, the single-piece housing can be formed by a casting or molding process. The single-piece housing 102 may include a first side panel 114*a* and a second side panel 114*b* positioned opposite to and at a distance from the first side panel 114*a*. Further, the single-piece housing 102 may include a front surface 116 and a back surface 304, each of which extends from the first side panel 114*a* to the second side panel 114*b*. The first and second side panels 114*a*, 114*b* may or may not taper in width from the back surface 304 towards the front surface 116. Further, in certain example embodiments, the first and second side panels 114*a*, 114*b* may be flat planar surfaces; however, in certain other example embodiments, the side panels 114*a*, 114*b* may be curved.

The back surface 304 may include a surface mounting portion 104 located approximately at a middle portion of the back surface 304, and a finned portion comprising a plurality of heat sink fin structures 402 on either side of the surface mounting portion 104. In one example embodiment, the surface mounting portion 104 may be offset in size with respect to the finned portion of the back surface 304. In particular, as illustrated in FIGS. 1, 2, 4, 5, 7, 8, and 11, the surface mounting portion 104 may be a raised portion that is taller compared to a height of the finned portion of the back surface 304. Alternatively, in some embodiments, the surface mounting portion 104 may not be offset in size from the finned portion of the back surface 304. That is, the height of the surface mounting portion 104 may be flush with the height of the finned portion as illustrated in FIG. 12.

Further, the surface mounting portion 104 may include a mounting plate assembly 412 that is configured to secure/mount the lighting system 102 to any appropriate mounting surface, such as a wall, a pole, a junction box, etc. For example, FIG. 12 illustrates the lighting system 100 coupled to a mast arm 1202 that allows the lighting system to be coupled to a post or other similar surfaces. In the example embodiment of FIG. 12, the raised part of the surface mounting portion 104 may be machined off (removed) such that a height of the surface mounting portion is flush with the finned portion. Alternatively, when the lighting system 100 is coupled to a junction box, a portion of the junction box may be visible because of a compact/reduced size of the lighting system 100 as compared to conventional lighting systems. Accordingly, in said example, the raised part of the surface mounting portion 104 may not be machined off so that the raised part may cover the junction box from being visible to a user after installation.

Even though the figures of the present disclosure illustrate a substantially rectangular shaped raised portion on the back surface 304 of the lighting system 100, one of ordinary skill in the art can understand and appreciate that the raised portion can be designed to have any other appropriate shape based on or irrespective of a shape of the mounting surface/structure on which the lighting system is to be mounted. For example, in some embodiments, the raised part may be curved like a semicircle. Further, in another example, the raised part may extend along the entire width of the single-piece housing 102, i.e., along the width of the back surface 304 from the first side panel 114*a* to the second side panel 114*b*.

As illustrated in FIGS. 1-4, the single-piece housing 102 may include (i) a light source portion 110 (herein 'light source compartment') configured to house one or more light source modules 406 and (ii) an electronic component portion 106 (herein 'electronic component compartment') configured to house one or more electronic components 704 (shown in FIG. 7) associated with the light source modules 406. Further, the light source compartment 110 and the electronic component compartment 106 may be separated by a wall 108.

In particular, the light source compartment 110 may include a substantially planar base 202 (herein 'base 202'). The base 202 may a plurality of include mounting points 320 (e.g., apertures, screw bosses, etc.) configured to receive fasteners, such as screws or any other type of connectors for securing one or more light source modules 406 to the underside (i.e., side that faces are to be illuminated after installation) of base 202 as illustrated in FIGS. 4 and 5. The plurality of mounting points 320 may be located at various positions on the base 202 to allow for multiple different numbers, positions, or configurations of light source modules secured to base 202. For example, in some embodiments, the lighting system 100 may have more than one light source module secured to the underside of the base 202. In addition to the light source modules 202, in some embodiments, one or more filler plates 410 may be coupled to the underside of the base 202 for various reasons, e.g., to enclose the wiring passageways 102, protect the components of the lighting system 100, for aesthetic purposes, etc.

As illustrated in FIGS. 4 and 5, the light source module 406 may include a light emitting diode (LED) panel having one or more LEDs disposed on a substrate, e.g., printed circuit board (PCB). Alternatively, the light source modules 406 may include any other point source or non-point source light modules without departing from a broader scope of the present disclosure. Further, in some embodiments, the light source module 406 may include a cover plate with light shields may be disposed on top of the substrate to reduce an amount of backlight emitted by the LEDs. The cover plate may include one or more apertures that align with the position of the LEDs disposed on the substrate and the LED's pass through their respective apertures on the cover plate.

Further, as illustrated in FIGS. 2 and 3, the light source compartment 110 may include a plurality of fins 112 extending substantially perpendicularly from the base 202 in a longitudinal direction between the front surface 116 and the partition wall 108 of the single-piece housing 102, for transferring heat away from one or more light source modules 406 secured to the underside of base 202.

Furthermore, the light source compartment 110 may include air flow openings 204 formed near the front surface 116 of the single-piece housing 102. The air flow openings 204 may define ambient air flow passageways in a direction generally perpendicular to the plane of the base 202 (e.g., generally vertical air flow passageways when the lighting system 100 is installed in a generally horizontal manner). As shown, each air flow opening 204 has an enclosed perimeter defined by the base 202, a pair of adjacent heat sink fins 112, and structure of the front surface 116 of the single-piece housing 102. Air flow openings 204 may provide increased convective heat transfer from the light source compartment 110.

Additionally, the light source compartment 110 may include a plurality of wire routing channels that partially define concealed wiring passageways for routing wiring from the electronics component portion 106 to the light source module(s) 406. The wire routing channels may be a raised portion (206, 207) within the base 202, as illustrated in FIGS. 2 and 3. In particular, the base 202 of the light source compartment 110 includes a main wire routing channel 206 that extends across the width of the single-piece housing 102 from the first end plate portion 314*a* to the second end plate portion 314*b*. Further, one or more branches may extend out from the main wire routing channel 206. As illustrated in FIG. 3, one such branched out wire routing channel 207 may be formed between adjacent heat sink fins 112 and may extend from a portion of the main wire routing channel 206 to an opening 316 of the inclined channel 706 in a direction of the partition wall 108. Light source modules 406 secured to the underside of base 202 may form the remaining side of the concealed wiring passageways, thus forming enclosed concealed wiring passageways 206, 207 as illustrated in FIG. 7.

As illustrated in FIGS. 3 and 7, the single-piece housing 102 may include an inclined channel 706 that extends downwards from an aperture 306 in the partition wall 108 to an aperture 316 in the base 202 of the light source compartment 110. In particular, the inclined channel 706 is defined by the partition wall 108 and the base 202. The channel 706 may be configured to provide a passage way for wires from electronic components in the electronic component compartment 106 to the concealed wiring passageways (206, 207) of the light source compartment 106. Further, a water/dust grommet 506 that allows a passage of wires therethrough, but prevents intrusion of water and/or dust from the light source compartment 110 to the electronic component compartment 106 may be disposed within the inclined channel 706. In particular, the inclined channel 706 and the apertures 306 and 316 on either end of the inclined channel 706 may be positioned such that they are concealed once the light source panels 406 are coupled to the single-piece housing 102. Accordingly, in certain example embodiments, the inclined channel 706 and the corresponding apertures (306, 316) may be positioned offset from middle portion of the single-piece housing 102. For example, the aperture 306 may be located offset from the center portion of the partition wall 108. However, in another example, the aperture 306 may be located approximately at a center portion of the partition wall 108.

As described above, in addition to the light source compartment 110, the single-piece housing 102 may include an electronic component compartment 106. As illustrated in FIGS. 3, 7 and 8, the electronic component compartment 106 may be a substantially rectangular shaped hollow compartment that extends from the partition wall 108 to the back surface 304 in a first direction and from the first side panel 114*a* to the second side panel 114*b* in a second direction. Alternatively, electronic component compartment 106 may have any other appropriate geometric or non-geometric shape without departing from a broader scope of the present disclosure.

In particular, the electronic component compartment 106 may include a top surface 397 and an open bottom surface 398 as illustrated in FIG. 3. In particular, the open bottom surface 398 of the electronic component compartment 106 may be configured to receive a removable access door 404 that covers the open bottom surface, as illustrated in FIGS. 4 and 8.

The access door 404 may include a first surface 802 and a second surface 804 that is opposite to the first surface 802. Further, the access door 404 may include one or more through apertures or other mounting points configured to align with apertures 214 or other mounting points formed at a bottom portion of the electronic component compartment 106, for receiving fasteners 880 therethrough to securely fasten the access door 404 to the electronic component compartment 106 of the single-piece housing 102. The access door 404 may provide access to the interior of electronic component compartment 106 by removing the fasteners 880 and detaching the door from the bottom portion of the electronic component compartment 106.

Further, the electronic component compartment 106 may include one or more screw bosses 212 located at any appropriate portion within the electronic component compartment 106 to receive screws or other connectors for securing electronic components, and other devices and/or structures to the electronic component compartment 106 of the single-piece housing 102. For example, as shown in FIGS. 7 and 8, example component(s) 704 (e.g., an LED driver, controller, surge monitor, terminal block, sensor, transformer, etc.) may be secured to a mounting bracket 702, which in turn may be secured to a screw bosses 212 located at a top surface 397 of the electronic component compartment 106 by one or more fasteners 210 or other connectors. The mounting bracket 702 may be described in greater detail in following paragraphs in association with FIGS. 9 and 10.

Figure 9:
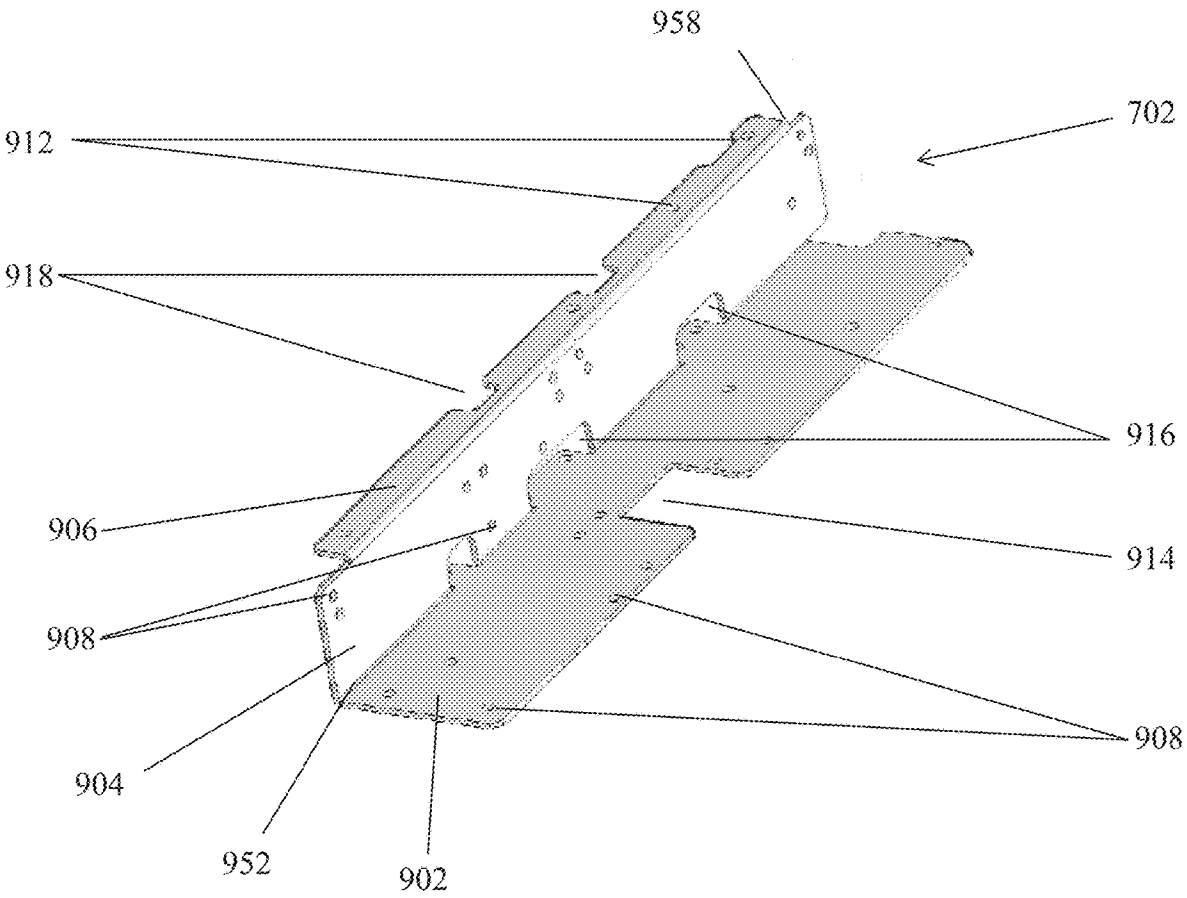
FIG. 9 illustrates a perspective view of the electronic component mounting bracket of the lighting system, in accordance with example embodiments of the present disclosure.
Figure 10:
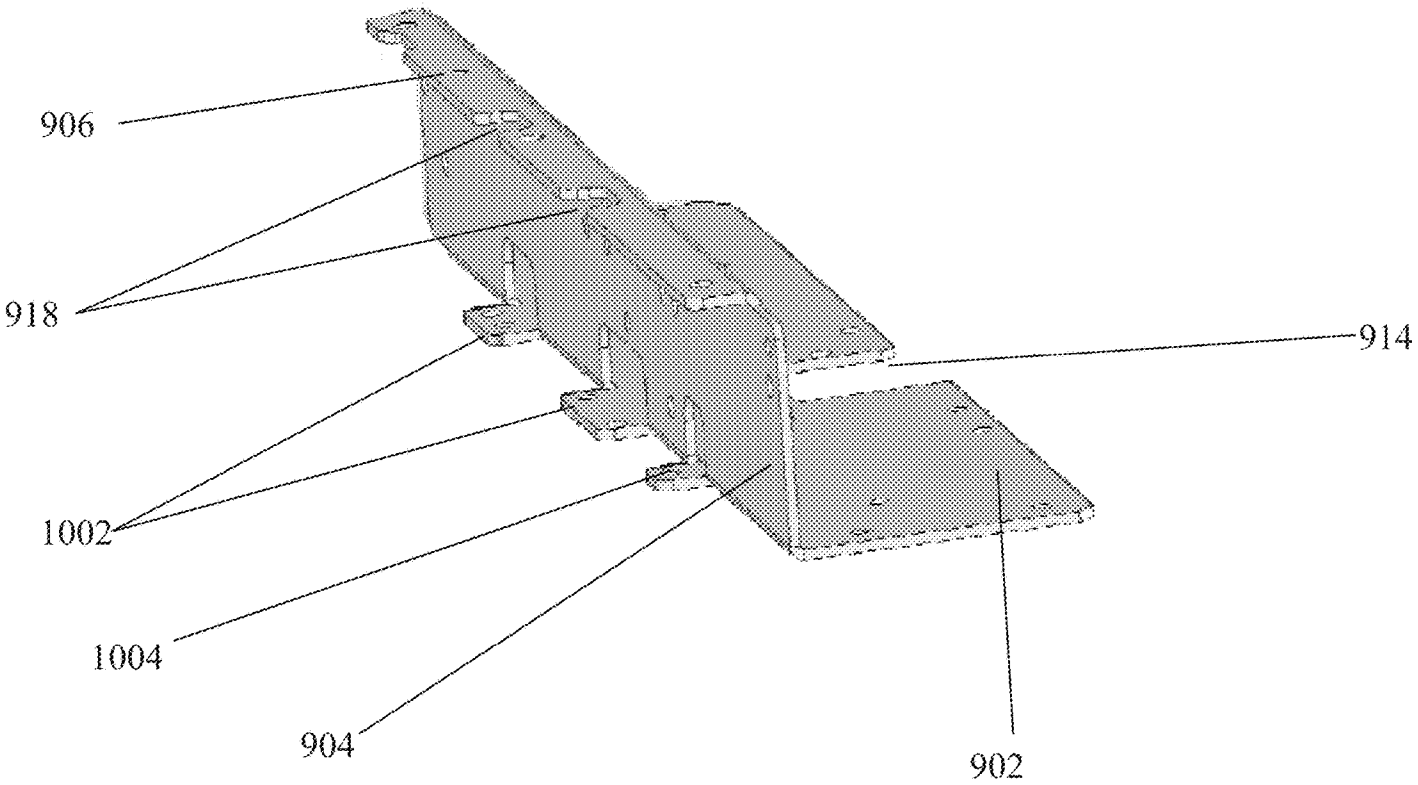
FIG. 10 illustrates another perspective view of the electronic component mounting bracket of the lighting system, in accordance with example embodiments of the present disclosure.

FIG. 9 illustrates a perspective view of the electronic component mounting bracket of the lighting system, in accordance with example embodiments of the present disclosure, and FIG. 10 illustrates another perspective view of the electronic component mounting bracket of the lighting system, in accordance with example embodiments of the present disclosure. Referring to FIGS. 9 and 10, the mounting bracket 702 may be an elongated and substantially L-shaped bracket configured to secure one or more electronic components 704 or other devices or structures to the lighting fixture 100.

In particular, the mounting bracket 702 may include an elongated first leg member 902 (herein 'first leg member 902') and an elongated second leg member 904 (herein 'second leg member 904') that extends substantially perpendicular to the first leg member 902 from a longitudinal end 952 of the first leg member 902. In one embodiment, each of the first leg member 902 and the second leg member 904 may be substantially rectangular shaped, however, in other embodiments, the leg members (902, 904) may have any other appropriate geometric or non-geometric shape.

Each of the first leg member 902 and the second leg member 904 may include a plurality of mounting points 908 (e.g., through holes, apertures, screw bosses, etc.) configured to receive fasteners or other appropriate connectors for securing one or more electronic components 704 (e.g., an LED driver, controller, surge monitor, terminal block, sensor, transformer, etc.) to the mounting bracket 702 as illustrated in FIGS. 7 and 8. The mounting points 908 may be located at various positions to allow for multiple different numbers, positions, or configurations of electronic components 704 secured to mounting bracket 702. For example, as illustrated in FIG. 7, an electronic component 704 may be coupled to the second leg 904 of the mounting bracket 702 such that at least a portion of the electronic component 704 may be in contact with top surface 397 of the electronic component compartment 106 that acts as a heat sink to transfer heat away from the electronic component 704. Alternatively, in certain other example embodiments, the electronic component 704 may be coupled to the first leg 902 of the mounting bracket 702.

Further, the mounting bracket 702 may include one or more bent out tabs 1002 that are partially cut and pushed out from second leg member 904. Alternatively, the bent out tabs 1002 may be partially cut and pushed out from the first leg member 902. In particular, in certain example embodiments, the bent out tabs 1002 may be pushed out such that the tabs 1002 rest in a plane of the first leg member 902 and are substantially perpendicular to the second leg member 904 as illustrated in FIGS. 9 and 10. Alternatively, the bent out tabs 1002 may be at an angle to the first leg member 902 and/or the second leg member 904.

The bent out tabs 1002 may include one or more mounting points 908 (e.g., through holes, apertures, screw bosses, etc.) configured to receive fasteners, such as screws or other connectors for securing one or more electronic components 704 to the mounting bracket 702. In particular, the bent out tabs 1002 may provide additional surface area for mounting larger electronic components that may extend beyond a size of the first leg member 902 and/or the second leg member 904.

In addition to the first leg member 902 and the second leg member 904, the mounting bracket 702 may include an elongated flange 906 that extends substantially perpendicular to the second leg member 904 from a longitudinal end 958 of the second leg member 904 that is distant from the first leg member 902. Further, the elongated flange 906 may extend from a longitudinal end 958 of the second leg member 904 along a partial or full length of second leg member 902. Furthermore, the elongated flange 906 may extend parallel to the first leg member 902 in an opposite direction. As illustrated in FIGS. 9 and 10, the flange 906 may include one or more mounting points 912 (e.g., through holes, apertures, screw bosses, etc.) to secure the mounting bracket 702 to the single-piece housing 102. For example, as illustrated in FIG. 7, the mounting points 912 of the elongated flange 906 may be aligned with the one or more screw bosses 212 on the top surface 397 of the electronic component compartment 106. Further, a fastener, such as a screw 710 or a rivet may be inserted through the aligned mounting points 912 and the screw bosses 212 to couple the mounting bracket 702 of the single-piece housing 102 within the electronic component compartment 106.

In addition to the one or more mounting points 908 and 912, the first leg member 902, the second leg member 904, and the elongated flange 906 may include one or more notches (914, 918) configured to accommodate or provide clearance for one or more structural features of the electronic component compartment 106 (e.g., ribs 210) and/or one or more features of the mounting assembly 412 (e.g., bolts, etc.). For example, the notches 918 of the flange 906 may be configured to account for the ribs 210 of the electronic component compartment 106. Similarly, the notch 914 of the first leg member 902 may be configured to account for a bolt associated with the mounting assembly 412. However, one of ordinary skill in the art can understand and appreciate that a mounting bracket 702 with fewer or no notches is within a broader scope of the present disclosure. Further, even though the present disclosure describes that the first leg member and the flange are substantially perpendicular to the second leg member, one of ordinary skill can understand and appreciate that the first leg member and the flange may be oriented at any appropriate angle to the second leg member without departing from a broader scope of the present disclosure.

In particular, the elongated flange 906 of the mounting bracket 702 may be configured such that it provides a separation between the light source compartment and the electronic components 704 coupled to the mounting bracket 702 to provide thermal insulation from heat generated by the light source modules 406. For example, as illustrated in FIG. 7, when the mounting bracket is coupled to the top surface 397 of the electronic component compartment 106, the elongated flange 906 provides a space 780 between the partition wall 108 and the first and second leg members 902, 906 of the mounting bracket 702 to which the electronic components 704 are coupled. Typically, the space 780 may have an air column that provides thermal insulation to the electronic components 704 from the heat generated by the light source modules 406. Alternatively, any other appropriate thermal insulation material may be disposed in the space 780. Further, in some example embodiments, the thermal insulation material may be disposed on either side of the first and/or second leg members 902, 904 to provide a thermal barrier (from the thermal load of the light sources) for the electronic components 704 coupled to the mounting bracket 702.

Furthermore, the mounting bracket 702 may operate as a heat sink for the electronic components by transferring heat away from the electronic components 704 via the single-piece housing 102. Accordingly, the mounting bracket 702 serves as a dual purpose component that operates as a heat sink and a thermal barrier provider for the electronic components.

Figure 11:
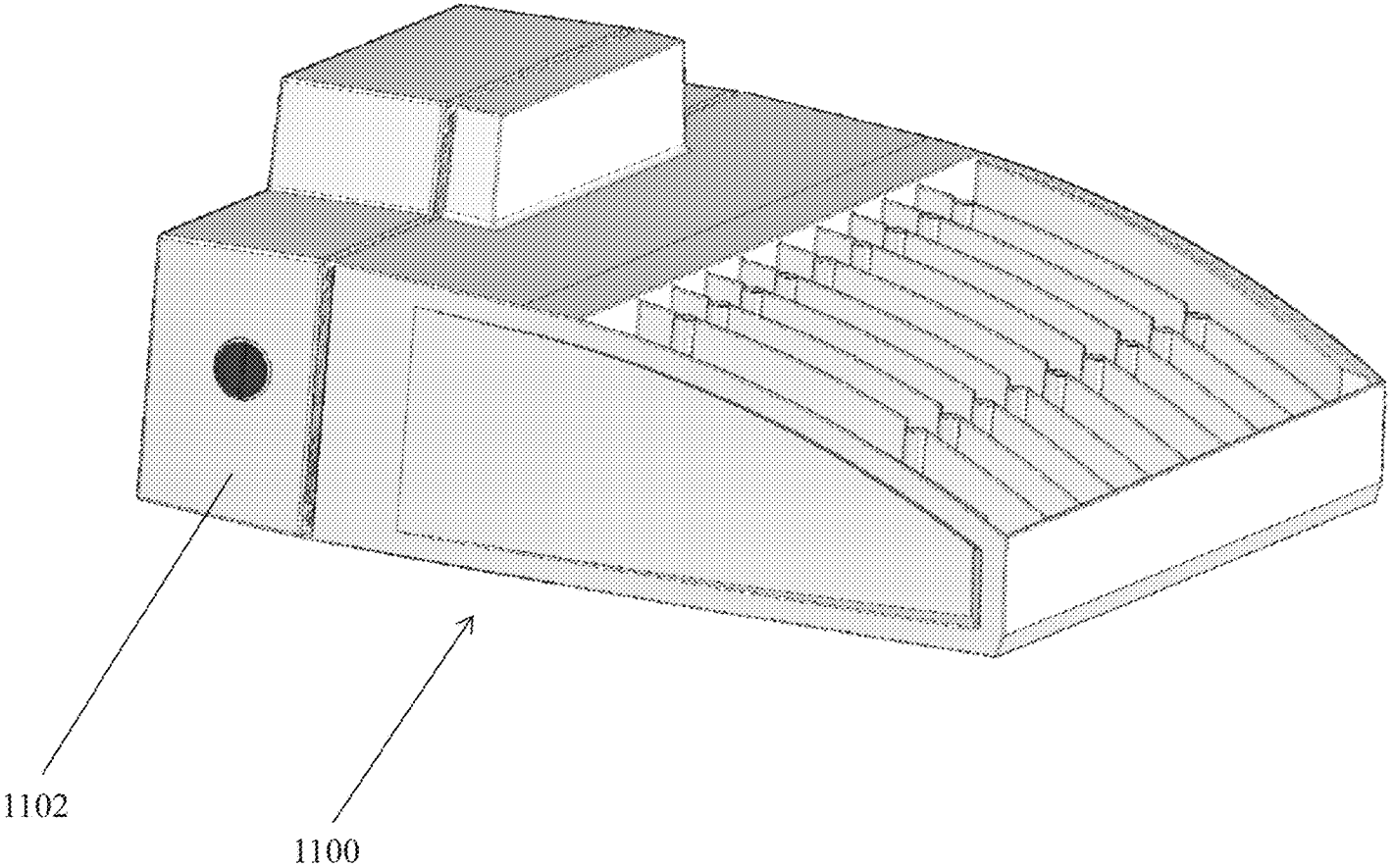
FIG. 11 illustrates a perspective view of the lighting system having a battery pack, in accordance with example embodiments of the present disclosure.

Turning to FIG. 11, this figure illustrates a perspective view of the lighting system having a battery pack, in accordance with example embodiments of the present disclosure. In particular, as illustrated in FIG. 11, the battery pack 1102 may be coupled to a back surface 304 of the single-piece housing 102. The lighting system 1100 of FIG. 11 may be self-contained in that the lighting system includes its own battery pack that provides power to operate the lighting system. Even though FIG. 11 illustrates the battery pack having a shape that is substantially similar to the shape of the single-piece housing's back surface 304, one of ordinary skill in the art can understand and appreciate that the battery pack may have any other geometric or non-geometric shape without departing from a broader scope of the present disclosure.

Although the inventions are described with reference to example embodiments, it should be appreciated by those skilled in the art that various modifications are well within the scope of the invention. From the foregoing, it will be appreciated that an embodiment of the present invention overcomes the limitations of the prior art. Those skilled in the art will appreciate that the present invention is not limited to any specifically discussed application and that the embodiments described herein are illustrative and not restrictive. From the description of the example embodiments, equivalents of the elements shown therein will suggest themselves to those skilled in the art, and ways of constructing other embodiments of the present invention will suggest themselves to practitioners of the art. Therefore, the scope of the present invention is not limited herein.

What is claimed is:

1. A lighting system comprising:

a housing comprising:

a light source portion having a base;

an electronic component compartment configured to house one or more electronic components;

a partition wall disposed between the light source portion and the electronic component compartment, wherein the partition wall separates the light source portion from the electronic component compartment; and a channel defined by the partition wall and the base, wherein the channel extends from the partition wall to the base providing a passageway from the electronic component compartment to the light source portion of the housing, wherein the channel is integral to the housing, and wherein the channel is inclined and extends downwards at an angle from the electronic component compartment to the light source portion;

a light source module coupled to the base of the light source portion, wherein the light source module comprises one or more light sources; and a grommet disposed in the channel to prevent an entry of external environmental elements from the light source portion of the housing to the electronic component compartment of the housing.

2. The lighting system of claim 1, further comprising:

a mounting bracket disposed within a cavity defined by the electronic component compartment and the partition wall of the housing, wherein the mounting bracket is removably coupled to a surface of the electronic component compartment, and wherein the one or more electronic components are mounted on or coupled to the mounting bracket.

3. The lighting system of claim 2, wherein the mounting bracket includes a plurality of mounting points for mounting the one or more electronic components.

4. The lighting system of claim 2, wherein the mounting bracket comprises:

a first elongated leg member;

a second elongated leg member extending substantially perpendicular to the first elongated leg member from a longitudinal edge of the first elongated leg member; and an elongated flange member extending substantially perpendicular to the second elongated leg member from a longitudinal edge of the second elongated leg member that is away from the first elongated leg member, wherein the elongated flange member is substantially parallel to the first elongated leg member and extends in a direction opposite to that of the first elongated leg member.

5. The lighting system of claim 4, wherein the elongated flange includes one or more apertures configured to removably couple the mounting bracket to the electronic component compartment of the housing.

6. The lighting system of claim 4, wherein the elongated flange is configured such that when the mounting bracket is coupled to the electronic component compartment, a space exists between the partition wall and the first and second elongated leg members of the mounting bracket to reduce an effect of heat generated by the one or more light sources on the one or more electronic components mounted on the mounting bracket.

7. The lighting system of claim 6, wherein when the mounting bracket is coupled to the electronic component compartment, an air column in the space acts as a thermal barrier between the light source portion and the one or more electronic components mounted on the mounting bracket.

8. The lighting system of claim 6, wherein a thermal insulation material is disposed in the space between the partition wall and at least one of the first and second elongated leg members of the mounting bracket.

9. The lighting system of claim 2, wherein the mounting bracket is configured to operate as a heat sink for the electronic components mounted on the mounting bracket, and wherein the mounting bracket transfers heat away from the electronic components via the housing.

10. The lighting system of claim 1, wherein the housing is a single-piece housing that further comprises: a plurality of heat sink fins extending from the base in a direction opposite to the direction of the light source module and substantially perpendicular to the base.

11. The lighting system of claim 1, wherein the housing further comprises: one or more air flow openings, each air flow opening defined by a combination of a front panel of the housing, one or more heat sink fins of the housing, and the base.

12. A lighting system comprising:

a housing comprising:

a light source portion configured to be coupled to a light source module comprising one or more light sources;

an electronic component compartment configured to house one or more electronic components; and a partition wall disposed between the light source portion and the electronic component compartment, wherein the partition wall separates the light source portion from the electronic component compartment; and a mounting bracket disposed within a cavity defined by the electronic component compartment in concert with the partition wall of the housing, wherein the mounting bracket is removably coupled to a surface of the electronic component compartment, wherein the one or more electronic components housed in the electronic component compartment are mounted on the mounting bracket, wherein the mounting bracket is configured to provide a thermal barrier between the light source portion and the one or more electronic components disposed in the electronic component compartment to reduce an effect of heat generated by the one or more light sources on the one or more electronic components, and wherein the housing is a single-piece housing.

13. The lighting system of claim 12, wherein the mounting bracket comprises:

a first elongated leg member;

a second elongated leg member extending substantially perpendicular to the first elongated leg member from a longitudinal edge of the first elongated leg member; and an elongated flange member extending substantially perpendicular to the second elongated leg member from a longitudinal edge of the second elongated leg member that is away from the first elongated leg member, wherein the elongated flange member is substantially parallel to the first elongated leg member and extends in a direction opposite to that of the first elongated leg member.

14. The lighting system of claim 13, wherein the elongated flange includes one or more apertures configured to removably couple the mounting bracket to the electronic component compartment of the housing.

15. The lighting system of claim 13, wherein the mounting bracket is configured to operate as a heat sink for the one or more electronic components mounted on the mounting bracket, and wherein the mounting bracket transfers heat away from the one or more electronic components via the housing.

16. The lighting system of claim 12, wherein the mounting bracket includes a plurality of mounting points for mounting the one or more electronic components.

17. The lighting system of claim 12, wherein the housing further comprises a channel extending from a portion of the partition wall to a portion of the light source portion providing a passageway from the electronic component compartment to the light source portion of the housing.

18. The lighting system of claim 16, wherein the channel is integral to the housing and is inclined at an angle extending downwards from the electronic component compartment to the light source portion.

19. The lighting system of claim 12, wherein the cavity defined by the electronic component compartment and the partition wall has one open side, and wherein the open side is covered by an access door panel that is removably coupled to the electronic component compartment.

20. The lighting system of claim 12, wherein the light source portion includes:

a base having a first surface and a second surface that is opposite the first surface;

a plurality of heat sink fins extending substantially perpendicularly from a first surface of the base in a longitudinal direction between a front surface of the housing and the partition wall of the single-piece housing; and a plurality of air flow openings positioned near the front surface of the housing, at least one air flow opening defined by a combination of a front panel of the housing, one or more heat sink fins of the housing, and the base, wherein the light source module is coupled to the second surface of the base opposite the plurality of heat sink fins.

* * * * *